US005531293A

United States Patent [19]

Nahar

[11] Patent Number: 5,531,293

[45] Date of Patent: Jul. 2, 1996

[54] CHECKOUT COUNTER GAP FILLER

[75] Inventor: Rathindra Nahar, Duluth, Ga.

[73] Assignee: AT&T Global Information Solutions Company, Dayton, Ohio

[21] Appl. No.: 275,866

[22] Filed: Jul. 15, 1994

[51] Int. Cl.[6] ..... A47F 9/04

[52] U.S. Cl. ..... 186/59

[58] Field of Search ..... 186/59, 61, 68, 186/69; 312/111, 198

[56] References Cited

U.S. PATENT DOCUMENTS 4,971,177 11/1990 Nojiri et al. ..... 186/61

5,229,588 7/1993 Detwiler et al. ..... 235/467

*Primary Examiner*—F. J. Bartuska

*Attorney, Agent, or Firm*—Paul W. Martin

[57] ABSTRACT

A checkout counter gap filler which allows liquids to pass through a gap between a checkout counter and an optical scanner, which is mounted within an aperture within the checkout counter, but prevents money and other unwanted debris from passing through the gap. The gap filler includes a rail member which is fastened along left and right sides of the scanner. The rail member includes an upper vertical portion having a bottom edge, a lower vertical portion having a top edge, and a horizontal shelf portion connecting the bottom edge of the upper vertical portion to the top edge of the lower vertical portion. The horizontal shelf portion includes a plurality of apertures which allow liquid to pass, but are small enough to prevent money and other debris from passing through.

10 Claims, 4 Drawing Sheets

CHECKOUT COUNTER GAP FILLER

BACKGROUND OF THE INVENTION

The present invention relates to optical scanners and checkout counters, and more specifically to a checkout counter gap filler.

Optical scanners are typically mounted within checkout counters. A section of the checkout counter is typically removed to form an aperture into which an optical scanner is mounted. The scanner is mounted so that the top surface of the scanner or a scale plate on top of the scanner is substantially flush with the top surface of the checkout counter. Front and back flanges rest on the top surface of the checkout counter to keep the scanner from falling through the aperture. Bolts or screws may be used to fasten the flanges to the checkout counter.

One scanner is disclosed in U.S. Pat. No. 5,229,588 entitled "Dual Aperture Optical Scanner", issued to Detwiler et al. on Jul. 20, 1993. This scanner is approximately eleven and one half inches wide. The typical checkout counter aperture is twelve inches wide. Therefore, gaps on either side of one-fourth inch are created when the subject scanner is mounted within the checkout counter. This patent is hereby incorporated by reference.

The width dimension of new scanners often differ from the width of aperture in order to provide clearance for a scale plate. Thus, when a scanner is replaced by a newer scanner, gaps may exist between the sides of the new scanner and the edges of the checkout counter defining the left and right sides of the aperture. These gaps allow coins, currency, credit cards, checks, photographs, driver's licenses, coupons, and other unwanted debris to fall through the aperture.

Prior attempts at filling the gaps have employed rubber strips or foam. However, such devices prevent spilled liquids from falling through the gaps.

Therefore, it would be desirable to provide a gap filler which prevents unwanted debris from falling through the gaps, but allows liquids and granular solids to fall through.

SUMMARY OF THE INVENTION

In accordance with the teachings of the present invention, a checkout counter gap filler is provided. The gap filler includes a rail member which is fastened along left and right sides of a scanner, which is mounted within an aperture within the checkout counter. The rail member includes an upper vertical portion having a bottom edge, a lower vertical portion having a top edge, and a horizontal shelf portion connecting the bottom edge of the upper vertical portion to the top edge of the lower vertical portion. The horizontal shelf portion includes a plurality of apertures which allow liquids and small granular debris to pass, but are small enough to prevent money and other debris from passing through.

It is accordingly an object of the present invention to provide a checkout counter gap filler which allows liquids and granular solid debris to pass but prevents money and other unwanted debris from passing through the gap.

It is another object of the present invention to provide a checkout counter gap filler which fits on both sides of an optical scanner.

It is another object of the present invention to provide a checkout counter gap filler which fastens to left and right sides of an optical scanner.

BRIEF DESCRIPTION OF THE DRAWINGS

Additional benefits and advantages of the present invention will become apparent to those skilled in the art to which this invention relates from the subsequent description of the preferred embodiments and the appended claims, taken in conjunction with the accompanying drawings, in which:

DETAILED DESCRIPTION OF THE PREFERRED EMBODIMENT

Figure 1:
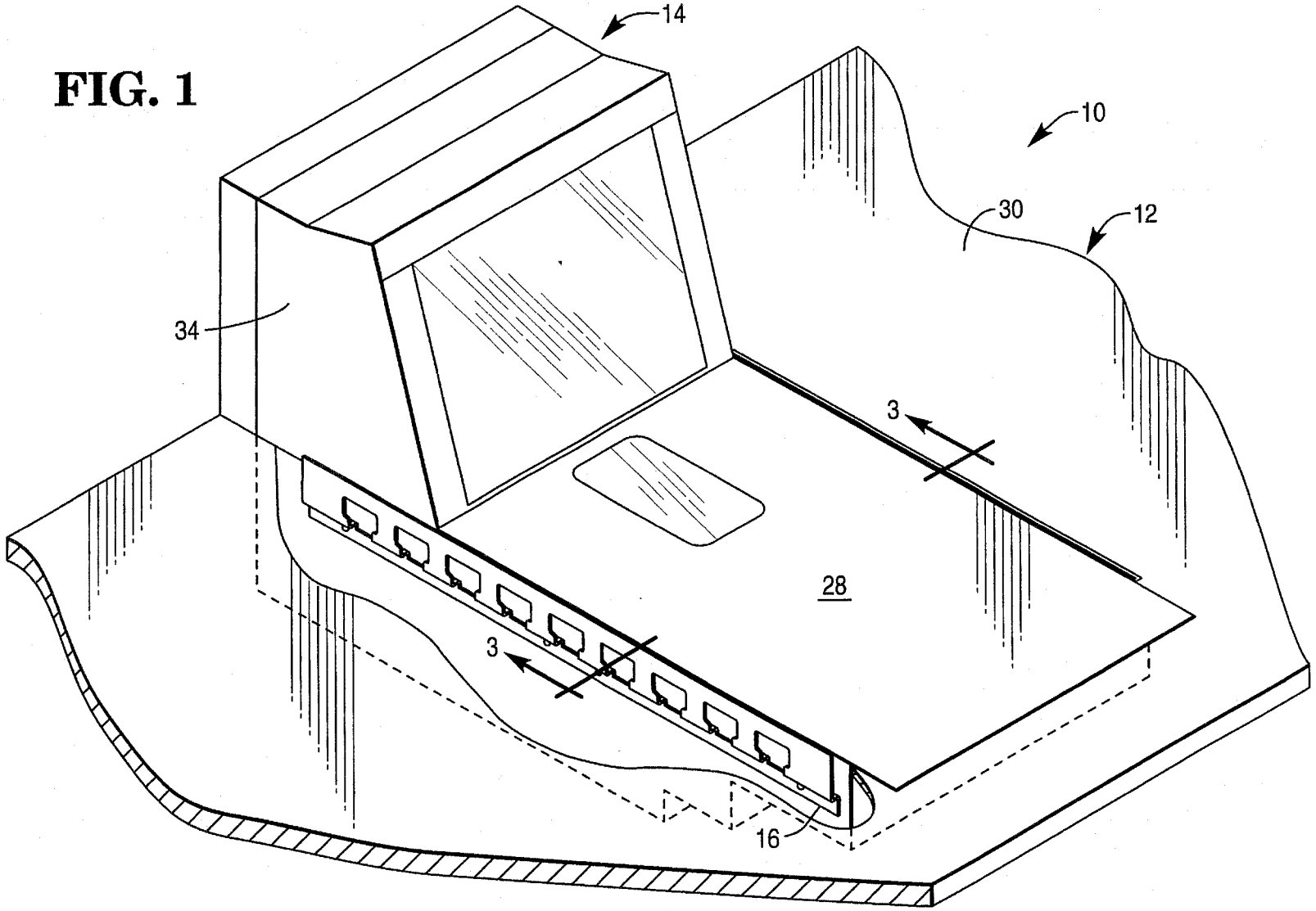
FIG. 1 is a perspective view of the checkout system of the present invention including a counter top, an optical scanner, and a checkout counter gap filler.
Figure 2:
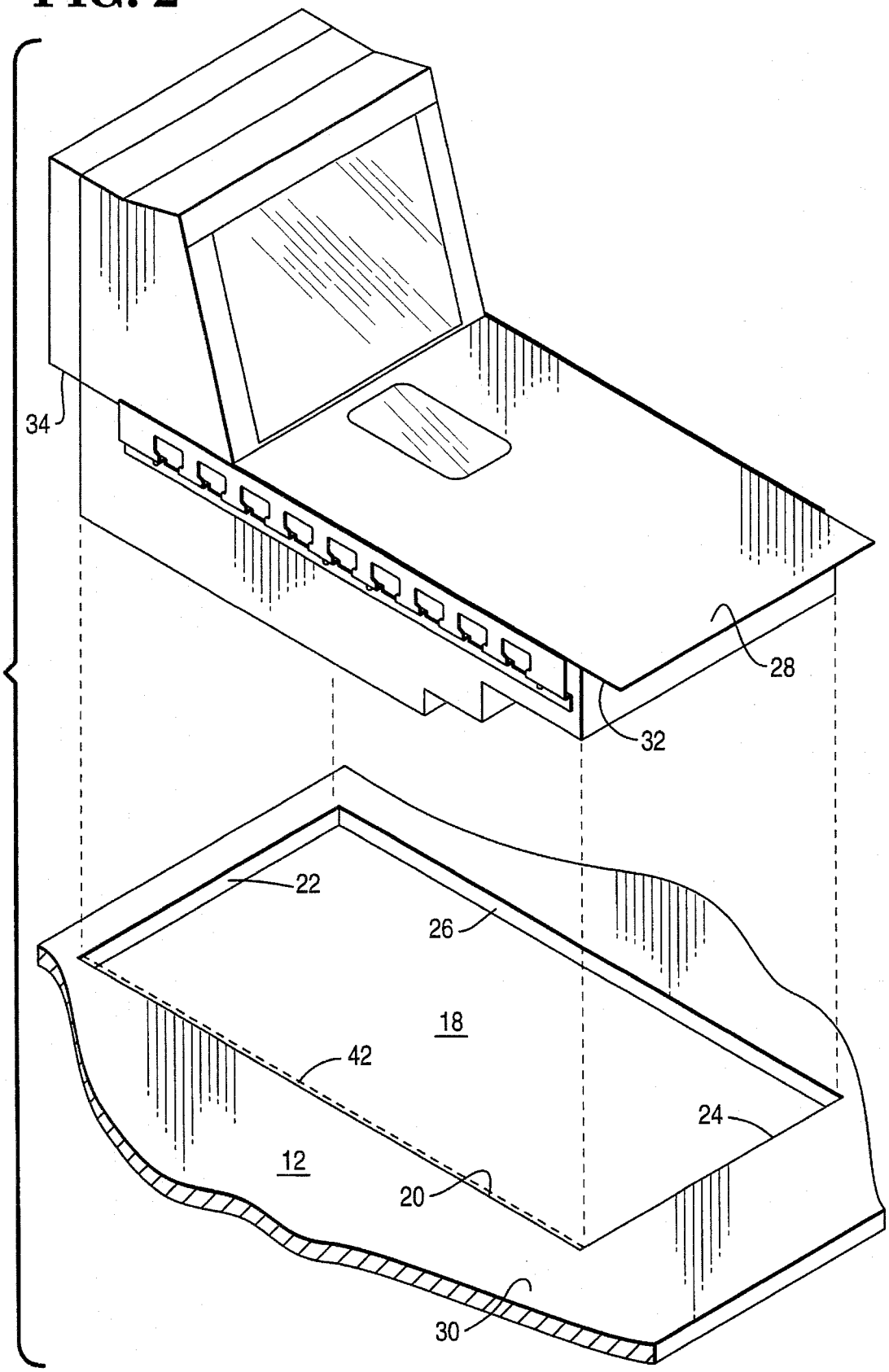
FIG. 2 is an exploded view of a checkout system of FIG. 1.

Referring now to FIGS. 1 and 2, system 10 includes checkout counter 12, optical scanner 14, and checkout counter gap filler 16.

Checkout counter 12 includes aperture 18 which is defined by left edge 20, rear edge 22, front edge 24, and right edge 26. Aperture 18 has a substantially rectangular shape.

Optical scanner 14 is preferably the optical scanner disclosed in the incorporated patent to Detwiler et al., but may be any countertop scanner. Optical scanner 14 includes scale plate 28, which is substantially flush with the top surface 30 of checkout counter 12. Front flange 32 (not visible) and rear portion 34 rest on top surface 30 to prevent scanner 14 from falling through aperture 18.

Checkout counter gap filler 16 is mounted along left side 36 of scanner 14. Another gap filler 16 is mounted in the same fashion on right side 38 (FIG. 3) of scanner 14. Gap filler 16 is preferably made of metal and fastened to scanner 14 by screws 40.

Figure 3:
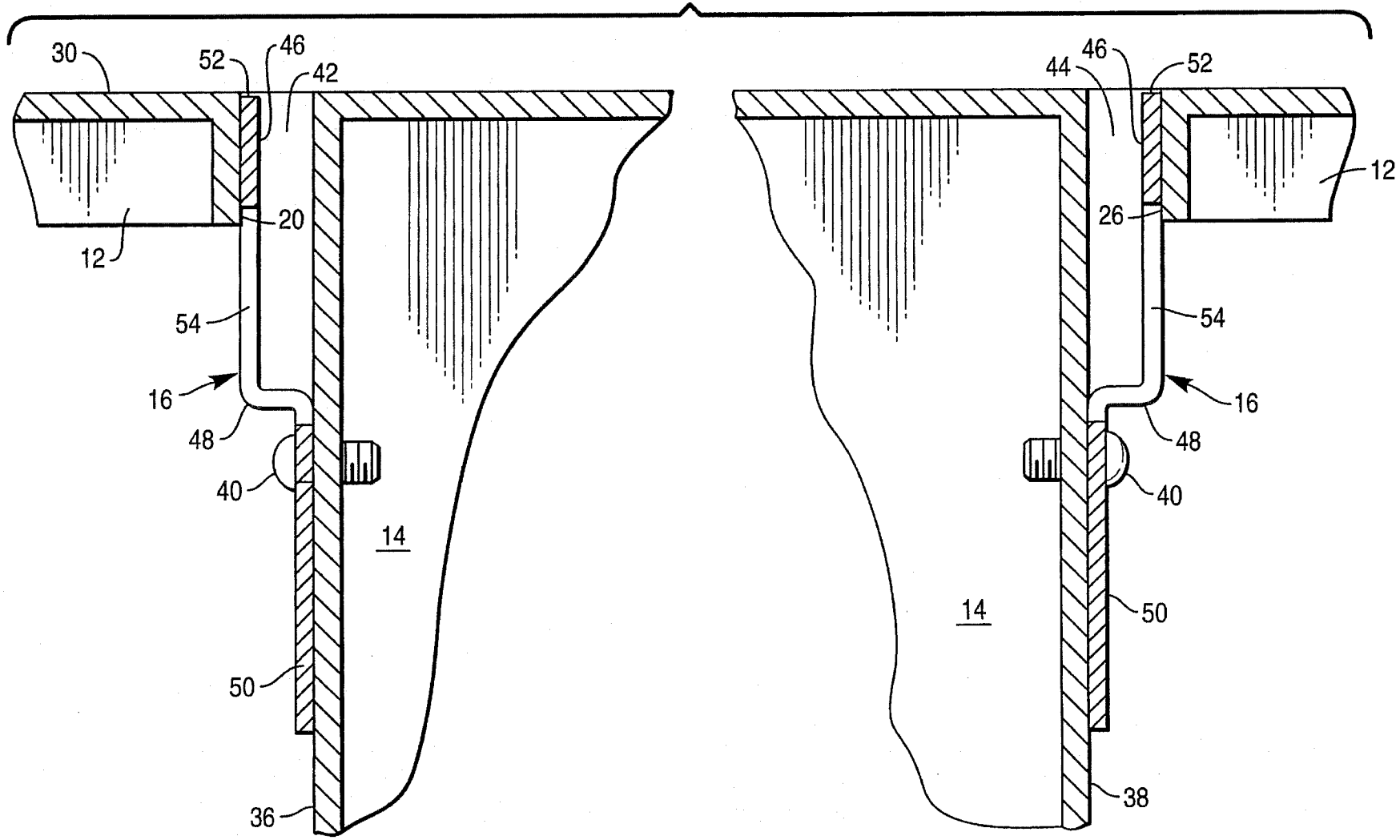
FIG. 3 is a cross-sectional view along line 3 of FIG. 1.

Turning now to FIG. 3, system 10 is shown in more detail. Gap 42 exists between left side 36 of scanner 14 and left edge 20 of aperture 18. Gap 44 exists between right side 38 of scanner 14 and right edge 26 of aperture 18. Gaps 42 and 44 are about one-fourth inch for the scanner of Detwiler et al.

Gap filler 16 includes an upper vertical portion 46, a horizontal shelf portion 48, and a lower vertical portion 50. Lower vertical portion is fastened to sides 36 and 38 of scanner 14. Upper vertical portion 46 includes a top edge 52 which preferably is aligned at or just below top surface 30 of checkout counter 12. Upper vertical portion 46 orients unwanted falling debris to a vertical position and horizontal shelf portion 48 prevents the debris from falling through aperture 18. Upper vertical portion 46 is preferably 1.10 inches high, making horizontal shelf portion 48 about 1.10 inches deep. Thus, unwanted debris, such as coins, currency, credit cards, checks, photographs, driver's licenses, and coupons can be easily removed from gaps 42 and 44. Advantageously, gap filler 16 also provides proper clearance for scale plate 28.

Gap filler 16 also includes a plurality of apertures 54 throughout its length. Apertures 54 allow spilled liquids and granular solids to pass, but are small enough to prevent unwanted debris from falling through. Items like frozen peas, cat litter, sugar, and macaroni pass through apertures 54. Items like coins, currency, credit cards, checks, photographs, driver's licenses, coupons, and other unwanted debris and other small items can be easily retrieved without lifting scanner 14 from checkout counter 12.

Figure 4:
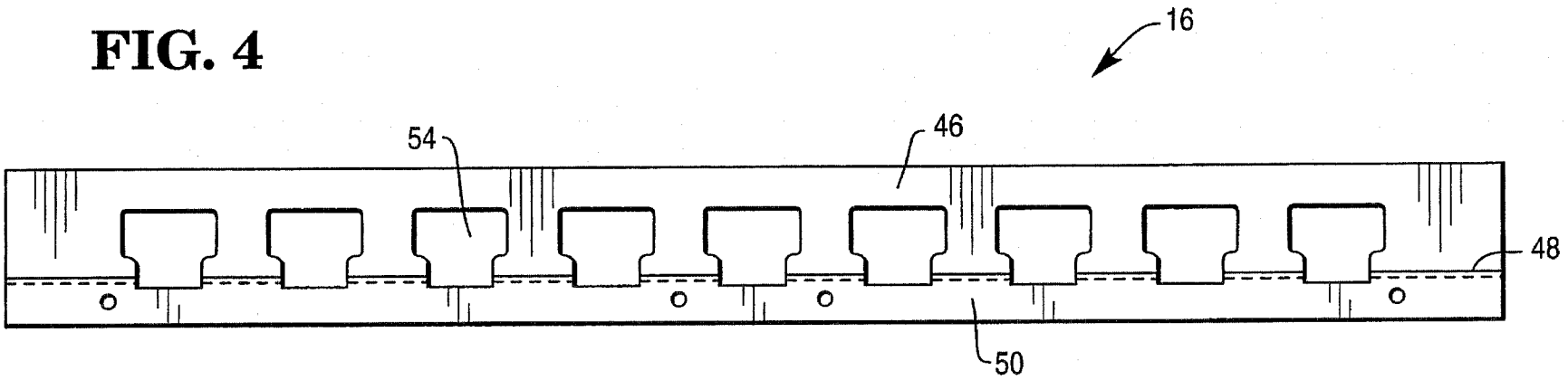
FIG. 4 is a side view of the checkout counter gap filler.
Figure 5:
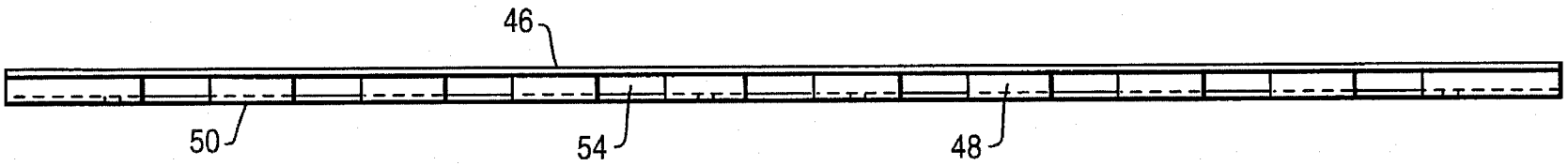
FIG. 5 is a top view of the checkout counter gap filer.

Turning now to FIGS. 4 and 5, apertures 54 are shown in more detail. Apertures 54 are predominantly located in upper vertical portion 46, but extend through horizontal shelf portion 48, and into lower vertical portion 50. The portions of apertures 54 within upper vertical portion 46 may be larger than coins, but coins do not fall through since they are oriented to a vertical position when they fall into gaps 42 and 44. The portions of apertures 54 within horizontal shelf portion 48 are narrower than coins, thus preventing coins from falling through.

It is envisioned by the present invention that some of apertures 54 may differ in shape from the remaining apertures so as to fit around structural features of individual scanners. They otherwise function in a similar fashion to the remaining apertures.

Gap filler 16 may be manufactured of stamped sheet metal or extruded plastic.

Although the present invention has been described with particular reference to certain preferred embodiments thereof, variations and modifications of the present invention can be effected within the spirit and scope of the following claims.

What is claimed is:

1. A device for filling a gap between a checkout counter and an optical scanner, which is mounted within an aperture within the checkout counter, the device comprising:

a rail member having an aperture through which liquids may pass, but having a size small enough to prevent money from passing, including an upper vertical portion adjacent the checkout counter and having top and bottom edges, a lower vertical portion adjacent the scanner and having top and bottom edges, and a horizontal shelf section linking the bottom edge of the upper vertical portion with the top edge of the lower vertical portion.

2. The device as recited in claim 1, wherein the aperture is located in the horizontal shelf portion.

3. The device as recited in claim 2, wherein the aperture is also located in the upper vertical portion.

4. The device as recited in claim 1, wherein the lower vertical portion is fastened to the scanner.

5. The device as recited in claim 4, further comprising:

screws which fasten the lower vertical portion to the scanner.

6. The device as recited in claim 4, wherein the lower vertical member is fastened to a side of the scanner.

7. The device as recited in claim 1, wherein the top edge of the upper vertical portion is aligned with a top surface of the checkout counter.

8. A device for filling a gap between a checkout counter and an optical scanner, which is mounted within an aperture within the checkout counter, the device comprising:

a rail member including a upper vertical portion adjacent the checkout counter and having a bottom edge;

a lower vertical portion fastened to a side of the scanner and having a top edge; and a horizontal shelf section linking the bottom edge of the upper vertical portion with the top edge of the lower vertical portion and having a plurality of apertures through which liquids may pass, but each aperture having a size small enough to prevent money from passing.

9. A device for filling a gap between a checkout counter and an optical scanner, which is mounted within an aperture within the checkout counter and which has a periphery that is smaller than another periphery defining the checkout counter aperture, the device comprising:

a rail member mounted to the periphery of the scanner adjacent a top surface of the checkout counter and having an aperture through which liquids may pass but which has a size small enough to prevent predetermined articles from passing so that they can be retrieved from above the checkout counter, wherein the rail member includes an upper vertical portion adjacent the checkout counter and having top and bottom edges, a lower vertical portion adjacent the scanner and having top and bottom edges, and a horizontal shelf section linking the bottom edge of the upper vertical portion with the top edge of the lower vertical portion.

10. The device as recited in claim 9, wherein the rail member also prevents credit cards, checks, coupons, photographs, and driver's licenses from passing.

* * * * *